US008878372B2

(12) United States Patent
Bardon et al.

(10) Patent No.: US 8,878,372 B2
(45) Date of Patent: Nov. 4, 2014

(54) INTEGRAL COMPRESSOR-EXPANDER

(75) Inventors: Patrice Bardon, Houston, TX (US); Jason Kerth, Houston, TX (US); Sukchul Kang, Changwon (KR)

(73) Assignee: Dresser-Rand Company, Olean, NY (US)

( * ) Notice: Subject to any disclaimer, the term of this patent is extended or adjusted under 35 U.S.C. 154(b) by 223 days.

(21) Appl. No.: 13/521,785

(22) PCT Filed: Jan. 14, 2011

(86) PCT No.: PCT/US2011/021369

§ 371 (c)(1), (2), (4) Date: Dec. 18, 2012

(87) PCT Pub. No.: WO2011/088371

PCT Pub. Date: Jul. 21, 2011

(65) Prior Publication Data

US 2013/0091869 A1 Apr. 18, 2013

Related U.S. Application Data

(60) Provisional application No. 61/295,633, filed on Jan. 15, 2010, provisional application No. 61/303,270, filed on Feb. 10, 2010.

(51) Int. Cl.

| | |
|---|---|
| ***F02B 63/04*** | (2006.01) |
| ***H02K 7/18*** | (2006.01) |
| ***F04D 25/04*** | (2006.01) |
| ***F25J 1/00*** | (2006.01) |
| ***F25J 1/02*** | (2006.01) |
| ***F04D 29/058*** | (2006.01) |
| ***F01D 15/00*** | (2006.01) |
| ***F25B 9/06*** | (2006.01) |

(52) U.S. Cl.

CPC ..... *F25B 9/06* (2013.01); *F25J 2230/20* (2013.01); *F02J 1/0279* (2013.01); *F04D 25/04* (2013.01); *F25J 2280/20* (2013.01); *F25J 1/005* (2013.01); *F25J 1/0022* (2013.01); *F25J 1/0288* (2013.01); *F25J 1/0298* (2013.01); *F04D 29/058* (2013.01); *F01D 15/005* (2013.01); *F25J 1/0284* (2013.01)

USPC ..... 290/1 A

(58) Field of Classification Search

CPC ..... F25B 9/06; F01D 15/005; F04D 29/058; F04D 25/04; F25J 1/005; F25J 1/0284; F25J 1/0298; F25J 2230/20; F25J 1/0022; F25J 1/0288; F25J 1/0279; F25J 2280/20

USPC ..... 62/6; 290/1 A

See application file for complete search history.

(56) References Cited

U.S. PATENT DOCUMENTS 4,044,558 A * 8/1977 Benson ..... 60/520
8,177,532 B2 * 5/2012 Okaichi et al. ..... 418/3

* cited by examiner

*Primary Examiner* — Javaid Nasri
(74) *Attorney, Agent, or Firm* — Edmonds & Nolte, PC

(57) ABSTRACT

An integral compressor-expander assembly, including a cryogenic expander positioned in an overhung configuration on a central shaft; a multi-stage centrifugal compressor supported on the central shaft between at least two bearings; and a device coupled to the central shaft and configured to either supply rotational power to the central shaft or generate power from rotation of the central shaft, depending upon a current operational mode of the multi-stage compressor.

22 Claims, 2 Drawing Sheets

INTEGRAL COMPRESSOR-EXPANDER

The present application is a national stage application of PCT Pat. App. No. PCT/US2011/021369, filed Jan. 14, 2011, which claims priority to U.S. Provisional Patent Application Ser. No. 61/295,633, which was filed Jan. 15, 2010 and to U.S. Provisional Patent Application Ser. No. 61/303,270, which was filed Feb. 10, 2010. These priority applications are hereby incorporated by reference in their entirety into the present application, to the extent that they are not inconsistent with the present application.

BACKGROUND

This disclosure relates in general to an integral compressor-expander assembly used in refrigeration applications, particularly, in the liquefaction of natural gas. The term "integral" is generally defined to mean that the compressor and expander are mounted on a single, common shaft. In such refrigeration applications, cold gas expanders are used to produce low temperatures via pressure reduction of a flowing gas. Typically, mechanical energy is recovered from the expander to serve a useful purpose. The mechanical energy recovered from the expander can be provided to an electric generator, or to a compressor adapted to compress a gas stream. Recovering the energy directly to compression is usually the most efficient and cost effective means as it eliminates costly power generation equipment and associated energy losses.

Typically, when energy is recovered to compression, the configuration of the assembly is a single expander with radial inflow and axial outflow overhung on one end of a central shaft, and a single-stage compressor with axial inflow and radial outflow overhung on the other end of the shaft. In this configuration, the compression duty is constrained to precisely match the expansion duty to keep the assembly in power balance with no external driver or load. In addition, the pressure rise in the compressor is constrained to the amount that can be achieved by a single impeller.

When the expansion duty exceeds the compression duty or vice versa, an integrally geared arrangement may be used. With the integrally geared arrangement, multiple compressors with axial inlets and radial discharges may be driven by a single gear on multiple shafts, with the expander driving this same gear from another shaft. The gear may also be coupled to an external driver to provide additional power in the event the compression duty exceeds the expansion duty. The integral gear arrangement requires several bearings and seals, making its design complicated and leading to lower reliability and higher frequencies of machine downtime.

Therefore, there is a need to facilitate efficient energy recovery while achieving higher compression ratio in a single, reliable assembly.

SUMMARY

Embodiments of the disclosure may provide a compressor-expander assembly. The assembly may include a cryogenic expander positioned in an overhung configuration on a central shaft and a multi-stage centrifugal compressor supported on the central shaft between at least two bearings. The assembly may further include a device coupled to the central shaft and configured to either supply rotational power to the central shaft or generate power from rotation of the central shaft, depending upon a current operational mode of the multi-stage compressor.

Embodiments of the disclosure may also provide a method including expanding a fluid in a cryogenic expander, wherein the cryogenic expander is coupled to a central shaft to which a multi-stage centrifugal compressor and a device are also coupled. The method may further include rotating the cryogenic expander and creating a power output therefrom. In at least one embodiment, the device and the cryogenic expander drive the compressor if the power from the cryogenic expander is less than that required to drive the compressor. In another embodiment, the cryogenic expander may drive the device and the compressor if the power from the cryogenic expander is more than that required to drive the compressor. In yet another embodiment, the cryogenic expander may drive only the compressor if the power from the cryogenic expander is not more or less than required to drive the compressor.

Embodiments of the disclosure may also provide an apparatus including a cryogenic expander. During operation of the apparatus, the cryogenic expander may receive and cool a through flow of fluid entering the expander at ambient temperature or below. The apparatus may also include a compressor and a shaft operably coupling the expander and the compressor, where the shaft has a first end portion, a second end portion, and a longitudinal portion disposed between the expander and the compressor. The apparatus may also include a bearing rotationally supporting the longitudinal portion of the shaft and a casing enclosing the expander, the compressor, the first end portion of the shaft and the longitudinal portion of the shaft, with the second end portion of the shaft extending outwardly through the casing and adapted to be operatively coupled to a device operative to supply rotational power to the shaft, or to receive rotational power from the shaft, during operation of the apparatus.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
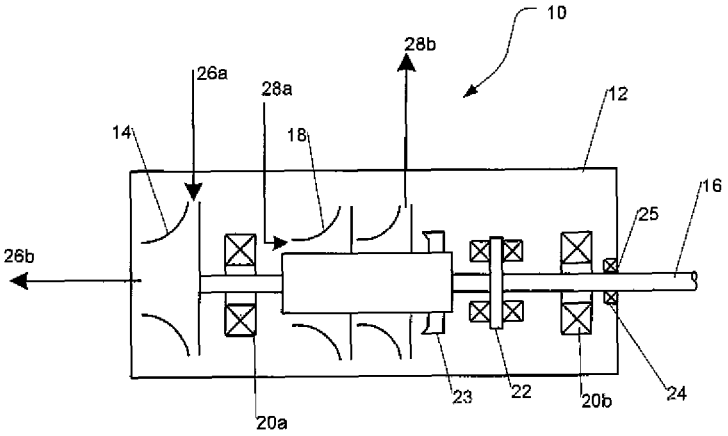
FIG. 1 is a schematic view of an exemplary integral compressor-expander, in accordance with the disclosure.

It is to be understood that the following disclosure describes several exemplary embodiments for implementing different features, structures, or functions of the invention. Exemplary embodiments of components, arrangements, and configurations are described below to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

In an exemplary embodiment, as illustrated in FIG. 1, an integral compressor-expander 10 that can be utilized for a multitude of functions, one of which may be to liquefy natural gas, is shown. The integral compressor-expander 10 may include a pressurized casing 12 enclosing a radial inflow/axial outflow cryogenic expander 14 representatively overhung on a first end portion of a central shaft 16 and a radial inflow/radial outflow multi-stage or multi-wheel centrifugal compressor assembly 18 axially-offset from the cryogenic expander 14 along a longitudinal portion of the central shaft 16. In another embodiment that expander 14 and the compressor 18 may be in separate casings that are coupled or otherwise attached together. The centrifugal compressor assembly 18 is representatively shown in an orientation in which a high pressure side of the compressor assembly 18 is farther away from the cryogenic expander 14 than a low pressure side of the compressor assembly 18. Further, although a pressurized casing will be generally described herein, the inventors contemplate that a non-pressurized casing could be used to implement embodiments of the present disclosure without departing from the scope thereof.

The orientation and/or configuration of the centrifugal compressor assembly 18 may be varied to suit a particular processing requirement, space, or other parameter that may conventionally be used to select a compressor unit. For example, one exemplary configuration of the assembly 18 is where the high pressure side of the compressor assembly 18 is adjacent the cryogenic expander 14. In other embodiments, the high pressure side may be positioned distant the expander 14. Additionally, the compressor could be in any number of other configurations, such as back to back, double flow, or compound compressor configurations without departing from the inventors' intended scope of the disclosure.

At least two radial bearings 20*a* and 20*b* and at least one thrust bearing 22 may be located within the pressurized casing 12. Moreover, numerous other internal seals can be implemented inside the casing 12 and configured to constrain internal leakages. The specific configuration and type of seals would depend on the application, but their various forms of implementation, although not specifically illustrated herein, do not depart from the scope of the present disclosure.

In at least one embodiment, the thrust bearing 22 can be located inboard (i.e., to the left of) from the radial bearing 20*b*, as illustrated. However, the thrust bearing 22 can also be disposed outboard (i.e., to the right of) from the radial bearing 20*b*. Having the thrust bearing 22 disposed outboard of the radial bearing 20*b* may allow the thrust bearing 22 to include a larger active area, thereby increasing its efficiency. In other exemplary embodiments, the radial bearing 20*b* and thrust bearing 22 can be located externally from the casing 12. Locating the radial bearing 20*b* and thrust bearing 22 outside of the casing 12 may prove advantageous in that the bearings 20*b*, 22 may be more accessible for assembly or maintenance purposes, and further, if these components are positioned outside of a pressurized casing, some of the challenges associated with operating bearings and thrust bearings may be avoided.

In at least one embodiment, the radial bearings 20*a* and 20*b* may be magnetic bearings, coupled with at least one catcher or coast down bearing (not shown) that may be configured to temporarily support the rotating shaft in the event of a magnetic bearing failure. As known in the art, magnetic bearings may function under pressure and, therefore, may generally meet minimal sealing standards for the processes disclosed herein. Also, magnetic bearings generally enjoy a wider range of temperature independence, which may prove advantageous in embodiments of the disclosure where temperatures are routinely below freezing, and into cryogenic temperature ranges. Moreover, magnetic bearings may be exposed directly to non-corrosive process fluids during operation, and yet continue to function properly.

Other kinds of bearings commonly used in turbomachinery, can also be used instead of, or in addition to, magnetic bearings. For example, in at least one embodiment, the radial bearings 20*a* and 20*b* may include lubricated oil bearings. Depending on the structural location of the bearings 20*a* and 20*b* (e.g., within out outside the casing 12), lubricated oil bearings can either have a pressurized lube-oil drain or an atmospheric lube oil drain with a pressurized supply. At least one advantage to using lubricated oil bearings may be that other parts of the integral compressor-expander 10 may also use lube-oil, whether received under pressure or at atmospheric pressures, such as a gear box or a motor generator. Thus, there would be no additional complexity to the implementation of a lube oil system to support bearings. However, the inventors recognize that the oil used in the lube oil system would likely need to be maintained at an acceptable temperature for lubrication, i.e., heated to maintain the appropriate viscosity, which is within the scope of the present disclosure.

As illustrated, the radial bearing 20*a*, which can be located between the cryogenic expander 14 and the centrifugal compressor assembly 18, may be exposed to fluid flowing through the cryogenic expander 14 and/or the centrifugal compressor assembly 18. In an exemplary embodiment, the radial bearing 20*a* may be an oil lubricated bearing, wherein oil is supplied to the radial bearing 20*a* at an elevated pressure such that the pressure in a drain line of the radial bearing 20*a* is coincident with a normal operating pressure between the cryogenic expander 14 and centrifugal compressor assembly 18, so that additional seals at the bearing location are not required. However, the implementation of other seals, such as labyrinth seals or other passive seals, may be included in these regions without departing from the scope of the disclosure. In an alternative embodiment, at least one bearing and/or seal may be positioned radially outward of the expander outlet, thus removing the overhung configuration. However, in this embodiment, the bearing and/or seal would likely require special construction/materials to be able to effectively operate in the cryogenic temperature range that is likely at the output of the expander 14.

A balance piston 23 may be located within the pressurized casing 12. The size and location of the balance piston 23 depend on axial forces that are developed during operation of the integral compressor-expander 10. In one or more embodiments, the balance piston 23 may be passive, or may be controlled using control elements (not shown) in a manner known to those of skill in the art. However, in other embodiments, the balance piston 23 may be controlled using known techniques, such as pressurized gas or oils. At least one seal 24 may be disposed on the central shaft 16 adjacent an opening 25 in the pressurized casing 12. In at least one embodiment, the second end portion of the central shaft 16 that is not disposed within the pressurized casing 12 may extend through the opening 25. In operation, the seal 24 may be configured to substantially prevent leakage of fluids, such as process gas, outward through the opening 25 of the pressurized casing 12.

In at least one embodiment, the seal 24 may be a dry gas seal, which generally has the least amount of leakage in similar applications. Nitrogen may be used as the feed gas to the dry gas seal, but process gas could also be used if it were conditioned to the proper pressures and conditions. In other embodiments, the seal 24 may include at least one labyrinth seal. As known in the art, labyrinth seals are fairly inexpensive and predictably reliable. However, other kinds of passive seals (i.e., seals that do not require an external input but rely on the pressure differential to function) may also be used. For example, one or more brush seals may be used as the seal 24.

As can be appreciated, several different configurations can exist in how the radial bearings 20*a* and 20*b*, the thrust bearing 22, and the seal 24 are disposed in the integral compressor-expander 10 system. Depending on the application, for example, the seal 24 can operate either inboard or outboard of the radial bearing 20*b* and thrust bearing 22. Thus, in at least one embodiment, both the radial bearing 20*b* and thrust bearing 22 may be located externally from the casing 12, as described above, while the seal 24 functions to prevent fluid leakage through the opening 25. In other exemplary embodiments, only one of either the radial bearing 20*b* or thrust bearing 22 may be located externally from the casing 12, having the seal 24 interposed between the two.

During exemplary operation, a pressurized fluid 26 may enter the cryogenic expander 14 radially, expand therein, and exit axially. In another exemplary embodiment, the system may be configured such that the fluid may initially enter the centrifugal compressor assembly in a radial direction, and after the fluid is compressed, the fluid exits from the compressor assembly in a radial direction. Thus, it is apparent that the present disclosure provides for both radial and axial fluid input, as well as radial and axial fluid output. However, in the primary exemplary embodiment being discussed in this disclosure and shown in the Figures, the input to the compressor is radial and the exit is axial, although embodiments of the disclosure are clearly not limited to this particular configuration, as both radial and axial compressor inputs/outputs are contemplated.

Regardless of the particular configuration of inputs/outputs, in operation the expansion of the pressurized fluid 26 imparts energy to the cryogenic expander 14 and causes the cryogenic expander 14 to rotate. Rotation of the cryogenic expander 14 may, in turn, cause the central shaft 16 to rotate, thereby causing the impellers of the centrifugal compressor assembly 18 to rotate. In one or more embodiments, fluid 28 may initially enter the centrifugal compressor assembly 18 radially and is subsequently directed to flow axially into the rotating impellers of the centrifugal assembly 18, where the fluid 28 is compressed by the rotating impellers of the centrifugal compressor assembly 18. Compressed fluid 28 may exit radially from the centrifugal compressor assembly 18.

For the sake of clarity, inlet conditions of fluids 26 and 28 are denoted as 26*a* and 28*a* in the Figures, respectively, and exit conditions of fluids 26 and 28 are denoted as 26*b* and 28*b* in the Figures, respectively. Representative ranges in inlet and exit temperature and pressure of the fluids 26 and 28 are provided in Table 1 below. However, Applicants note that each of the temperatures noted in the table are approximate (about the indicated temperature) and may vary (in range) by ±5%, 10%, 15%, 20%, or 30%. Therefore, the input stream temperature (26*a*), for example, may be as cold as −195° C. where the listed temperature is −150° C. Similarly, the input temperature range for stream 26*a* may be about −195° at the coldest (30% colder than 150) or about 65° C. at the warmest (30% warmer than 50° C.).

TABLE 1

| | Approximate pressure | | Approximate temperature | |
|---|---|---|---|---|
| | Min | Max | Min | Max |
| 26a | 2 bara | 165 bara | −150° C. | 50° C. |
| 26b | 1 bara | 50 bara | −170° C. | 15° C. |
| 28a | 1 bara | 50 bara | −150° C. | 200° C. |
| 28b | 2 bara | 165 bara | −130° C. | 260° C. |

As briefly described above, in other exemplary embodiments, the general disposition or configuration of the compressor components of the compressor assembly 18 can be reversed without departing from the scope of the disclosure. For example, the compressive direction of the impellers may allow the fluid 28 to enter the compressor assembly 18 and move axially from right to left, with respect to the Figures. In at least one embodiment, the balance piston 23 can also be moved to the other side of the compressor assembly 18 to compensate for the reversal of thrusts attained through the varying embodiments and/or configurations of the compressor assembly 18. Furthermore, the number of rotating impellers, or "stages," can be increased in applications where higher compression ratios can be achieved.

Operation of the cryogenic expander 14 and centrifugal compressor assembly 18 may give rise to axial forces along the central shaft 16. The axial forces may be supported by the thrust bearing 22 and the balance piston 23. Radial forces, which are potentially generated by the rotating shaft 16, and rotor weight may be supported by the radial bearings 20*a* and 20*b*. Additional conduits (not shown) may be present to provide sealing fluids, vents and valves as needed for operation of the bearings 20*a*, 20*b* and 22, balance piston 23 and seal 24.

Since the expander 14 may not always be in thrust balance with the compressor assembly 18, the balance piston 23 can, in at least one embodiment, be replaced (or supplemented) with an active thrust balancing system (not shown). In at least one embodiment, the active thrust balancing system may include a system adapted to control the pressure of a cavity defined within the casing 12 through the use of an external valve (not shown). The valve may be configured to regulate the bleeding of the pressure within the cavity back to a lower, predetermined pressure. In one or more embodiments, the cavity may be located behind the expander 14, and be fluidly coupled via the valve to a location in front of the expander 14 where the pressure is substantially lower. The balance diameter of the cavity located behind the expander 14 could be adapted to provide a thrust force at normal operating conditions in order to counter the thrust that may be generated at the opposing sealed end, where the seal 24 is located. In at least one embodiment, the resulting thrust force derived from the cavity may be configured to generate a net zero thrust on the expander 14 at normal operating conditions. In the event the valve fails and there is no balance piston 23 backup, the valve may be designed to fail in an open condition, thereby giving the cavity located behind the expander 14 a pressure equal or substantially equally to that of the expander outlet 14. Consequently, in the event of valve failure, the net thrust on the shaft 16 would be equal to the thrust due to the sealed end.

Figure 2:
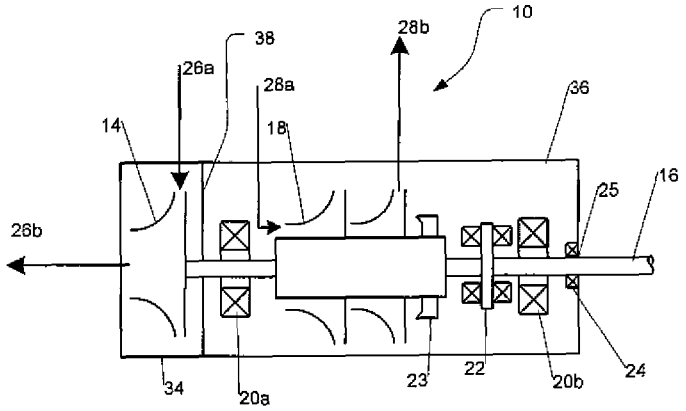
FIG. 2 is a schematic view of the integral compressor-expander in an exemplary embodiment where the expander and compressor are in separate housings joined together.

In an exemplary embodiment, the pressurized casing 12 may be fabricated as one piece to house the components of the integral compressor-expander 10. In other exemplary embodiments, as illustrated in FIG. 2, the pressurized casing 12 may be composed of two pieces, a cryogenic expander housing 34 and a compressor housing 36, that are directly coupled together in a contiguous relationship along an interface 38. In at least one embodiment, the cryogenic expander housing 34 and compressor housing 36 can be coupled together using a series of bolts (not shown), but the two housings 34, 36 may also be coupled by welding or other known methods for securing casings into a unitary body. As illustrated in FIG. 2, the bearings 20*a*, 20*b* and 22 and seal 24 can be housed within the compressor housing 36. In other embodiments, additional bearings and/or seals may also be located at the opening 25.

Figure 3:
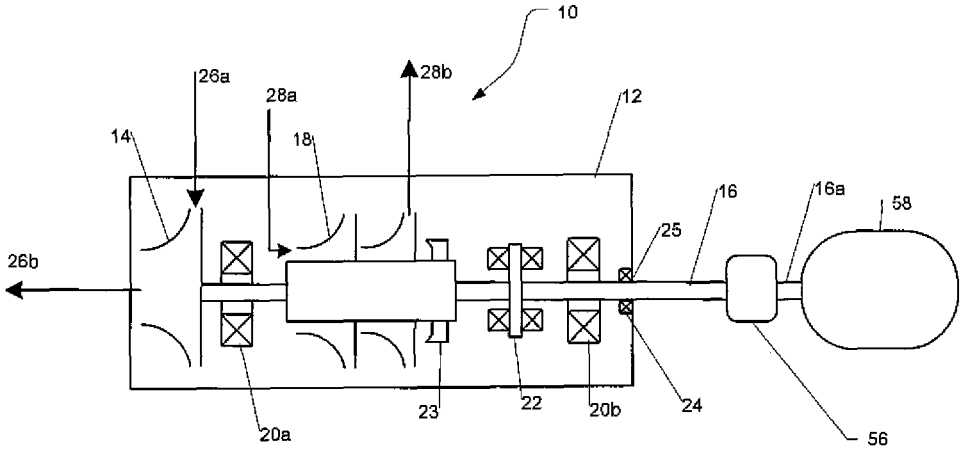
FIG. 3 is a schematic view of the integral compressor-expander in an exemplary configuration where a device is coupled to the central shaft.

The compression ratio of the centrifugal compressor assembly 18 necessary to achieve a target pressure and temperature of the fluid 28 is not necessarily constrained by the power output of the cryogenic expander 14. As illustrated in FIG. 3, a shaft coupling 56 may be used to couple a device 58, which is supported on a shaft 16*a*, to the second end portion of the central shaft 16. In at least one embodiment, shaft 16*a* may be a continuation of the central shaft 16, or a separate independent shaft. The shaft coupling 56 may be a rigid coupling or a flexible coupling, depending on the application. A speed increasing or decreasing gear (not shown) may also be coupled between the device 58 and the integral compressor-expander 10.

In an exemplary embodiment, the device 58 may be adapted to supply rotational power to the shaft 16, receive rotational power from the shaft 16, or supply rotational power to and receive rotational power from the shaft 16, depending upon a current operational mode of the compressor assembly 18. In exemplary embodiments where the device 58 is configured to receive rotational power from the shaft 16, the device 58 may include a generator and/or compressor. In exemplary embodiments wherein the device 58 supplies rotational power to the shaft 16, the device 58 may include a motor or turbine. However, there may also be exemplary embodiments where the device 58 includes a combination of a motor and a generator, wherein the device 58 can be configured to supply rotational power to the shaft 16 in one operating mode and receive the rotational power from the shaft 16 in another operating mode. In at least one embodiment of the disclosure, the device 58 may include a high speed high frequency motor, as is often times used in the art to drive high speed compression equipment where a turbine is not practical or otherwise desired.

In operation, when the power from the cryogenic expander 14 is less than that required to drive the compressor assembly 18, the device 58 can be adapted to supply additional rotational power to the shaft 16. In this configuration, the combination of the device 58 and cryogenic expander 14 may cooperatively drive the compressor assembly 18. If the input of rotational power from the cryogenic expander 14 is more than that required to drive the compressor assembly 18, the device 58 may receive rotational power from the shaft 16. In this configuration, the device 58 and the compressor assembly 18 can be driven by the cryogenic expander 14. If the power from the cryogenic expander 14 is not more or less than that required to drive the compressor assembly 18, the cryogenic expander 14 drives only the compressor assembly 18. In configurations where the device 58 receives power from the shaft 16, the device 58 may be configured, for example, to either generate electricity (as a generator) or to further process as fluid (as a compressor). In either embodiment, the device 58 may be configured to capture excess power generated by the expander 14 and provide useful work product therefrom.

In another embodiment, the operation of the expander 14, compressor 18, and the additional device 58 may be controlled by an electronic controller. For example, a controller (not shown) may be configured to receive inputs representative of the power status of each of the components and generate control signals responsive thereto. As such, in a situation where the expander 14 is providing excess power to the compressor 18, then the controller may be configured to activate the device 58 (an electric motor/generator) to receive and convert the excess power into electricity that may then be used to run other equipment or transmitted back to the electrical supply grid so that a cost credit may be received. Further, in the situation where the expander 14 is not providing enough power to the compressor 18 to generate the desired compression, then the controller may be configured to activate the device 58 (an electric motor/generator) to provide additional rotational power to the shaft 16 to supplement the rotational power provided by the expander 14. Thus, the controller may be configured to control the operation of each of the components of the entire system based upon sensed inputs and a predetermined algorithm that determines what state each of the components should be operating in under the current circumstance/sensed inputs.

Figure 4:
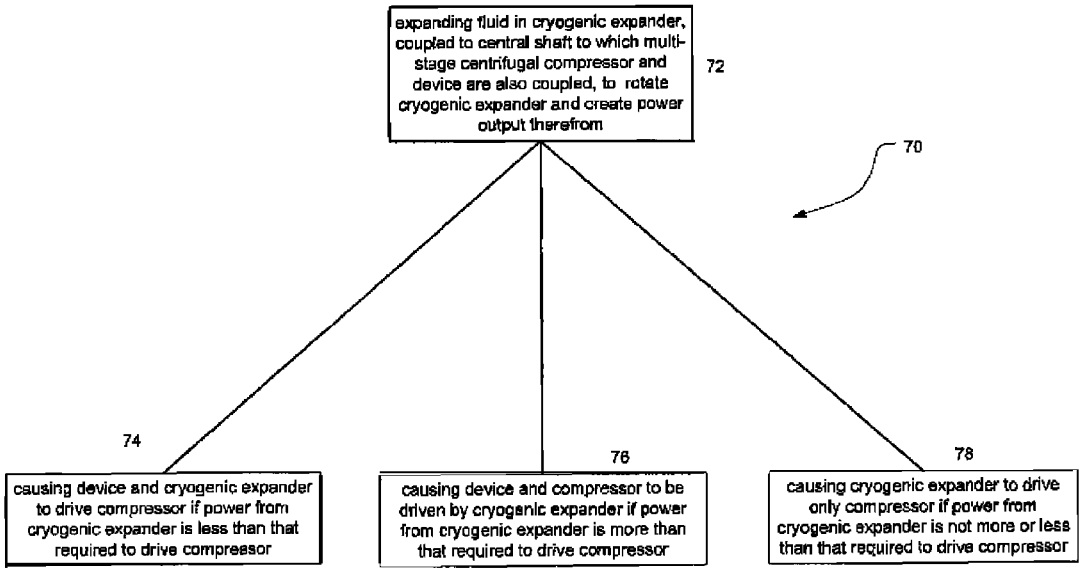
FIG. 4 is a flow chart of an exemplary method of driving a compressor using the integral compressor-expander.

In an exemplary embodiment, as illustrated in FIG. 4, a method of driving a compressor is generally referred to by the reference numeral 70 and includes expanding a fluid in a cryogenic expander, coupled to a central shaft to which a multi-stage centrifugal compressor and a device are also coupled, to rotate the cryogenic expander and create a power output therefrom as indicated in block 72. If the power from the expander is less than that required to drive the compressor, the device and the cryogenic expander drive the compressor as indicated in block 74. The device and the compressor are driven by the cryogenic expander if the power from the cryogenic expander is more than that required to drive the compressor as indicated in block 76. The cryogenic expander drives only the compressor if the power from the cryogenic expander is not more or less than that required to drive the compressor as indicated in block 78.

Although the present disclosure has representatively described embodiments relating to the liquefaction of natural gas, it is understood that the apparatus, systems and methods described herein could be applied to other environments without departing from the scope of the disclosure. For example, according to another exemplary embodiment, rotating machinery used in industrial refrigeration may be configured to use embodiments of the integral compressor-expander systems as described above.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A compressor-expander assembly, comprising:

a cryogenic expander positioned in an overhung configuration on a central shaft;

a multi-stage centrifugal compressor supported on the central shaft between at least two bearings;

a balance piston positioned along the central shaft between an outlet of the multi-stage centrifugal compressor and one of the at least two bearings; and a thrust bearing positioned along the central shaft.

2. The compressor-expander assembly of claim 1, further comprising:

an electric motor generator combination coupled to the central shaft and configured to supply rotational power to the central shaft or generate power from rotation of the central shaft, depending upon a current operational mode of the multi-stage compressor.

3. The compressor-expander assembly of claim 2, wherein:

the cryogenic expander and the multi-stage centrifugal compressor are contained in a single casing; and the central shaft extends from the single casing and is coupled to the electric motor generator combination.

4. The compressor-expander assembly of claim 1, further comprising a rotating machinery device coupled to the central shaft, wherein the rotating machinery device is configured to either provide rotational power to or receive rotational power from the central shaft.

5. The compressor-expander assembly of claim 1, wherein the cryogenic expander is a radial input axial output expander.

6. The compressor-expander assembly of claim 1, wherein the at least two bearings comprise at least one of radial magnetic bearings and lubricated oil bearings.

7. The compressor-expander assembly of claim 1, wherein the cryogenic expander is contained in a first casing and the multi-stage centrifugal compressor is contained in a second casing, the first casing and the second casing being coupled together.

8. The compressor-expander assembly of claim 1, wherein the cryogenic expander is configured to receive an input fluid stream that is at a temperature of between about 50° C. and about −150° C.

9. The compressor-expander assembly of claim 1, wherein an output pressure from the multi-stage centrifugal compressor is between about 2 bara and about 165 bara.

10. A compressor-expander assembly, comprising:

a cryogenic expander positioned in an overhung configuration on a central shaft and configured to expand a pressurized fluid flowing therethrough, thereby providing rotational power to the central shaft;

a multi-stage centrifugal compressor supported on the central shaft between at least two bearings; and an electric motor generator combination coupled to the central shaft and configured to supply rotational power to the central shaft or generate power from rotation of the central shaft, depending upon a current operational mode of the multi-stage centrifugal compressor, wherein the electric motor generator combination is configured to operate in three modes comprising:

a first mode in which the cryogenic expander supplies the rotational power to the central shaft and the electric motor generator combination operates to generate electrical power from the rotation of the central shaft;

a second mode in which the cryogenic expander supplies the rotational power to the central shaft and the electric motor generator combination supplies additional rotational power to the central shaft; and a third mode in which the cryogenic expander supplies the rotational power to the central shaft and the electric motor generator combination rotates with the central shaft without adding rotational power thereto or generating electric power therefrom.

11. The compressor-expander assembly of claim 1, wherein a fluid may initially enter the multi-stage centrifugal compressor radially and compressed fluid may exit radially from the multi-stage centrifugal compressor.

12. The compressor-expander assembly of claim 1, wherein the multi-stage centrifugal compressor is in a back to back configuration, a double flow configuration, or a compound compressor configuration.

13. A method comprising:

expanding a fluid in a cryogenic expander to create a rotational output on a central shaft to which the cryogenic expander, a multi-stage centrifugal compressor and a driver/generator device are directly coupled for concomitant rotation;

driving the multi-stage centrifugal compressor with the driver/generator device and the cryogenic expander if the output from the cryogenic expander is less than that required to drive the multi-stage centrifugal compressor;

driving the driver/generator device and the multi-stage centrifugal compressor with the cryogenic expander if the output from the cryogenic expander is more than that required to drive the multi-stage centrifugal compressor; and driving only the multi-stage centrifugal compressor with the cryogenic expander if the output from the cryogenic expander is not more or less than that required to drive the multi-stage centrifugal compressor.

14. The method of claim 13, further comprising positioning the cryogenic expander in an overhung configuration on the central shaft.

15. The method of claim 13, further comprising supporting the driver/generator device on the central shaft.

16. An apparatus, comprising:

an overhung cryogenic expander configured to receive and cool an input fluid stream while generating rotational work;

a multi-wheel centrifugal compressor;

a shaft operably coupling the cryogenic expander to receive the rotational work and also coupled to the multi-wheel centrifugal compressor, the shaft having a first end portion, a second end portion, and a longitudinal portion disposed between the overhung cryogenic expander and the multi-wheel centrifugal compressor;

a bearing rotationally supporting the longitudinal portion of the shaft;

a casing enclosing the overhung cryogenic expander, the multi-wheel centrifugal compressor, the first end portion of the shaft and the longitudinal portion of the shaft, with the second end portion of the shaft extending outwardly through the casing and adapted to be operatively coupled to an external piece of rotating machinery;

a balance piston positioned along the shaft between a compressor outlet of the multi-wheel centrifugal compressor and the bearing; and a thrust bearing positioned along the shaft.

17. The apparatus of claim 16, wherein an interior of the casing is pressurized.

18. The apparatus of claim 16, wherein the overhung cryogenic expander comprises an expander inlet and an expander outlet, and the multi-wheel centrifugal compressor further comprises a compressor inlet none of the expander inlet, the expander outlet, the compressor inlet, and the compressor outlet is directly exposed to an exterior of the casing.

19. The apparatus of claim 16, wherein the input fluid stream is received by the cryogenic expander at a temperature of between about 50° C. and about −150° C.

20. The apparatus of claim 16, wherein an output pressure from the multi-wheel centrifugal compressor is between about 2 bara about 165 bara.

21. A compressor-expander assembly, comprising:

a cryogenic expander positioned in an overhung configuration on a central shaft and configured to receive and expand an input fluid stream, thereby providing rotational power to the central shaft; and a multi-stage centrifugal compressor supported on the central shaft between at least two bearings, wherein the compressor-expander assembly may further include an electric motor generator combination coupled to the central shaft and configured to supply rotational power to the central shaft or generate power from rotation of the central shaft, depending upon a current operational mode of the multi-stage centrifugal compressor;

wherein the cryogenic expander is a radial input axial output expander; and/or wherein the at least two bearings comprise at least one of radial magnetic bearings and lubricated oil bearings; and/or wherein the cryogenic expander and the multi-stage centrifugal compressor are contained in a single casing, and the central shaft extends from the single casing and is coupled to the electric motor generator combination; and/or wherein the cryogenic expander is contained in a first casing and the multi-stage centrifugal compressor is contained in a second casing, the first casing and the second casing being coupled together; and/or wherein the compressor-expander assembly further comprises a balance piston positioned along the central shaft between an outlet of the multi-stage centrifugal compressor and one of the at least two bearings, and a thrust bearing positioned along the central shaft; and/or wherein the input fluid stream is received by the cryogenic expander at a temperature of between about 50° C. and about −150° C.; and/or wherein an output pressure from the multi-stage centrifugal compressor is between about 2 bara and about 165 bara; and/or wherein the electric motor generator combination is configured to operate in three modes comprising a first mode in which the cryogenic expander supplies the rotational power to the central shaft and the electric motor generator combination operates to generate electrical power from the rotation of the central shaft, a second mode in which the cryogenic expander supplies the rotational power to the central shaft and the electric motor generator combination supplies additional rotational power to the central shaft, and a third mode in which the cryogenic expander supplies the rotational power to the central shaft and the electric motor generator combination rotates with the central shaft without adding rotational power thereto or generating electric power therefrom; and/or wherein fluid may initially enter the multi-stage centrifugal compressor radially and compressed fluid may exit radially from the multi-stage centrifugal compressor; and/or wherein the multi-stage centrifugal compressor is in a back to back configuration, a double flow configuration, or a compound compressor configuration.

22. An apparatus, comprising:

an overhung cryogenic expander configured to receive and cool an input fluid stream while generating rotational work;

a multi-wheel centrifugal compressor;

a shaft operably coupling the cryogenic expander to receive the rotational work and also coupled to the multi-wheel centrifugal compressor, the shaft having a first end portion, a second end portion, and a longitudinal portion disposed between the overhung cryogenic expander and the multi-wheel centrifugal compressor;

a bearing rotationally supporting the longitudinal portion of the shaft;

a casing enclosing the overhung cryogenic expander, the multi-wheel centrifugal compressor, the first end portion of the shaft and the longitudinal portion of the shaft, with the second end portion of the shaft extending outwardly through the casing and adapted to be operatively coupled to an external piece of rotating machinery;

a balance piston positioned along the shaft between a compressor outlet of the multi-wheel centrifugal compressor and the bearing; and a thrust bearing positioned along the shaft; and/or wherein the interior of the casing is pressurized; and/or wherein the overhung cryogenic expander comprises an expander inlet and an expander outlet, and the multi-wheel centrifugal compressor further comprises a compressor inlet, none of the expander inlet, the expander outlet, the compressor inlet, and the compressor outlet is directly exposed to an exterior of the casing; and/or wherein the input fluid stream is received by the cryogenic expander is at a temperature of between about 50° C. and about −150° C.; and/or wherein an output pressure from the multi-wheel centrifugal compressor is between about 2 bara about 165 bara.

* * * * *